United States Patent [19]

Barnes

[11] Patent Number: 4,732,183

[45] Date of Patent: Mar. 22, 1988

[54] METHOD AND APPARATUS FOR PEELING VENEER

[75] Inventor: Derek Barnes, Vancouver, Canada

[73] Assignee: MacMillan Bloedel Limited

[21] Appl. No.: 40,331

[22] Filed: Apr. 20, 1987

[51] Int. Cl.[4] ..... B27L 5/00

[52] U.S. Cl. ..... 144/357; 144/211; 144/365

[58] Field of Search ..... 144/209 R, 209 A, 209 B, 144/211, 365, 367

[56] References Cited

U.S. PATENT DOCUMENTS 767,466 5/1904 Wolfinger .

1,209,052 11/1916 Sinclair .

1,957,166 5/1934 Hartzell .

*Primary Examiner*—W. Donald Bray

*Attorney, Agent, or Firm*—C. A. Rowley

[57] ABSTRACT

A method and apparatus for peeling a tapered block by setting the cutting edge of the peeling knife on an angle comensurate with the taper of the block. In one embodiment, the angle remains substantially constant throughout the peeling operation so that the resulting core is tapered. In another embodiment, the angle continuously changes and the veneer is cut thicker at one side than at the other whereby to produce a tapered veneer and result in a substantially right cylindrical core when the peeling operation is completed.

9 Claims, 8 Drawing Figures

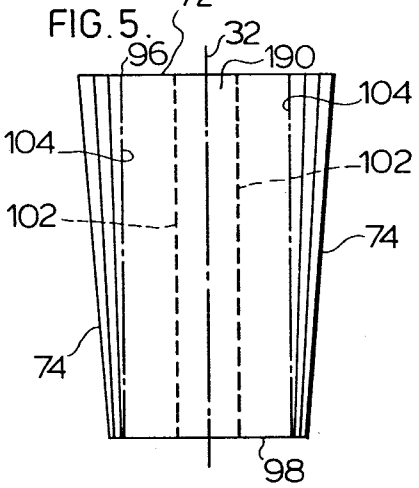
FIG. 5.
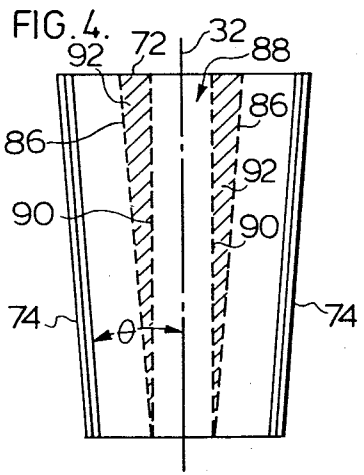
FIG. 4.
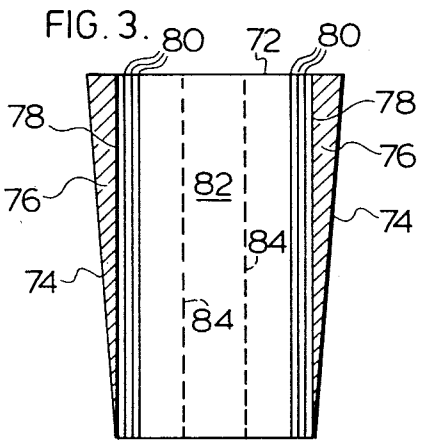
FIG. 3.
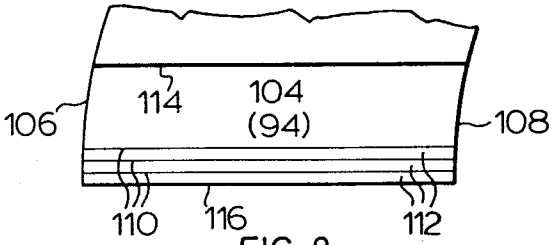
FIG. 8.
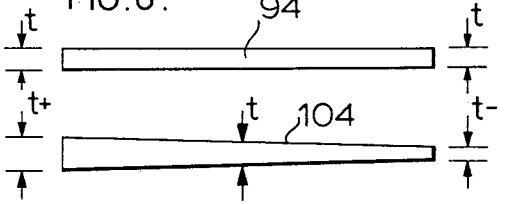
FIG. 6.
FIG. 7.

METHOD AND APPARATUS FOR PEELING VENEER

FIELD OF THE INVENTION

The present invention relates to peeling of wood bolts, more particularly, the present invention relates to peeling of tapered wood bolts by cutting same on a taper.

BACKGROUND OF THE PRESENT INVENTION

The production of veneer for a variety of different purposes including plywood manufacture, laminated veneer lumber or, in some cases, oriented strand lumber, it is common practice to mount wooden bolts on a lathe and rotate same around an axis substantially parallel to the longitudinal axis of the tree from which the bolt was formed, i.e. with the annual rings extending circumferentially about the axis of rotation. In such systems as is well known the cutting edge of the knife is mounted substantially parallel to the axis of rotation and is held in this parallel orientation as it is advanced toward the axis as the log is peeled thereby to produce a substantially uniform thickness veneer (there will be some deviation due to defects, etc) and a substantially right cylindrical core when the peeling operation is completed. It will be apparent that as peeling occurs since the knife edge remains parallel to the axis of rotation, the veneer produced is of uniform thickness and the length of each side edge of the veneer is the same so there is little tendency for the veneer to curl.

It is also been suggested to cut tapered veneers particularly for the production of the walls of a bucket by mounting the blade on an arm and pivoting the arm around a center pin located axially spaced from the end of the bolt. Such devices are shown in U.S. Pat. No. 767,466 issued Aug. 16, 1904 to Wolfinger and U.S. Pat. No. 1,209,052 issued Dec. 19, 1916 to Sinclair. These devices cut on a taper so that the veneer produced is necessarily thicker at one end than other and with one side edge longer than the other so the veneer will tend to curl.

U.S. Pat. No. 1,957,166 issued May 1, 1934 to Hartzell also discloses a concept of cutting a veneer basically in the same manner as some pencil sharpeners operate.

It is common practice to sense the bolt as it approaches the lathe to provide an indication of the taper and shape of the bolt and then to grip the bolt in a particular fashion so that it may be mounted in the lathe in a selected position to determine the location of the axis of rotation of the bolt in the lathe and thereby to maximize the amount of veneer produced from a given bolt.

In modern lathes, the peeling knive is mounted on a knife carriage which in turn is mounted on a pair of side blocks one at each end of the carriage. The side blocks are mounted in tracks and are advanced by a suitable feed mechanism one at each side of the machine controlled to advance the carriage with the knife substantially parallel to the axis of rotation of the bolt, i.e. with both axial ends of the knife travelling at the same speed. In many of the modern machines, the rate of advance or degree of advancement of each side block is continuously measured to ensure that the knife carriage presents the knife edge substantially parallel to the axis of rotation throughout the peeling operation. In many cases, such a system includes independent hydraulic drives for each side block, measuring the displacement of each side block and controlling the operation of the hydraulics to ensure that the side blocks are properly aligned to maintain the knife edge as above described.

It has been known on startup to cut veneer with the blade misaligned so that the cutting radius at one end of the block is shorter than at the other thereby producing a veneer longer on one side than the other forcing the same to curve. Such a condition while known to happen could not be tolerated for any significant length of time and thus was corrected immediately.

BRIEF DESCRIPTION OF PRESENT INVENTION

Is an object of the present invention to provide a system for increasing the mount of veneer attainable when peeling a tapered bolt.

It is a further object of the present invention to provide a system permitting cutting of a veneer from a bolt at an angle to the axis of rotation of the bolt so that the blade for cutting the veneer is more nearly parallel to the grain of wood thereby increase the effective of length of strands that may be formed therefrom.

Broadly, the present invention relates to a method and apparatus for peeling of the veneer from a tapered wood block by sensing the shape of the block rotating the block about a rotational axis in a veneer lathe having a cutting edge and peeling a veneer from the block with said cutting edge, the improvement comprising independently adjusting the opposite axial ends of said cutting edge in accordance with the shape of said wood block so that said edge is not parallel to the axis of rotation at least at the commencement of the peeling operation and is set at an angle to said axis of rotation in accordance with said taper so that the end of said edge adjacent the larger diameter (butt) end of said block is spaced farther from said axis of rotation of said block then the opposite end of said edge.

One embodiment of the invention, the cutting angle of the knife to the axis of rotation will be substantially equal to or less than the angle of taper of the wood block as sensed by the sensing mean, i.e. the cone angle and the said cutting angle will be held substantially constant until peeling veneer from the block is completed so that a substantially uniform cross-sectional thickness veneer is formed and a conical core remains after completion of the peeling.

In a second embodiment of the present invention, the said cutting angle is less than the angle of taper of the wood block as sensed by sensing means, i.e. less than the cone angle which results in peeling a veneer thicker on one side edge than on the other. Under these conditions of peeling, i.e. cutting to produce a tapered thickness veneer, the angle of the blade or cutting edge to the axis of rotation of the block changes as peeling proceeds thereby to produce a veneer that is thicker on one edge than on the other. In one arrangement the angle continuously changes and is controlled based on the overall size of the bolt, cone angle, diameter, etc, to provide a substantially right cylindrical core when the peeling operation is completed and a veneer having a substantially constant difference in thickness at is two side edges.

In a second arrangement the knife is initially set to cut to produce veneer with say the maximum tolerable difference in thickness from side to side until the side blade edge is substantially parallel to said axis of rotation and then the blade edge is maintained substantially parallel to said axis of rotation until the peeling operation is completed. This manner of operation results in minimum curl of the veneer produced and produces substantially uniform thickness veneer during a significant portion of the peeling operation.

In all of the above, the veneer formed will tend to curve since the cutting radius at the base of the cone is larger than that at the opposite end of the block and thus a greater length of veneer tends to be peeled from the larger diameter end of the block. The amount of curl that can be tolerated will depend on the equipment and the end use to which the veneer is to be applied. It is the intention to clip the veneer as appropriate before the curvature has built up beyond the acceptable limit.

BRIEF DESCRIPTION OF THE DRAWINGS

Further features, objects, and advantages will be evident from the following detailed description of the preferred embodiment of the present invention taken in conjunction with the accompanying drawings in which:

FIG. 3 is a schematic representation of the conventional peeling operation.

FIG. 4 is a schematic representation of a tapered peeling operation.

FIG. 5 is a schematic illustration of a tapered peeling operation producing a tapered veneer during at least a portion of the peeling operation.

FIG. 6 is a section through a veneer produced following the methods illustrated in FIGS. 3 and 4.

FIG. 7 is a section through a tapered veneer portion produced following the method illustrated in FIG. 5.

FIG. 8 is a partial planned view of a veneer cut using the techniques illustrated in FIGS. 4 or 5.

DESCRIPTION OF THE PREFERRED EMBODIMENTS

Figure 1:
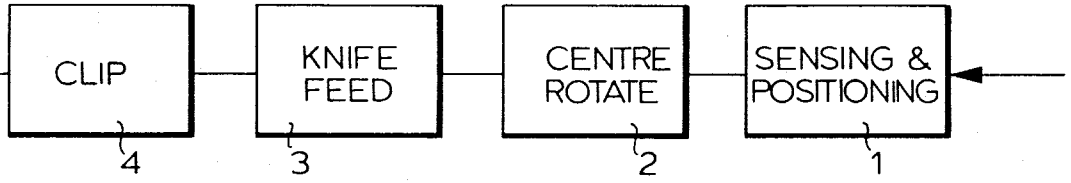
FIG. 1 is a schematic illustration of the operation of the present invention.

The concept of the present invention is indicated by the box diagram of FIG. 1. A wooden block enters the scanning and positioning station 1, is scanned and its shape recognized. It is then positioned on a carriage and carried into the lathe where as indicated by station number 2 it is centered and mounted for rotation. Next the knife feed moves the knife into position to cut or peel veneer from the block as it is rotated as indicated by the station 3. To this point, the description describes basically what happens in the prior art. When practicing the present invention, the sensed shape of the log carried out in station 1 is transmitted to the knife feed as indicated in the station 3 and the axial ends of the knife are independently advanced to set the cutting angle of the knife cutting edge relative to the axis of rotation of the block the lathe, so that the edge of the knife is substantially parallel to the outer surface of the block, i.e. to the basic cone or conical shape sensed by the sensing mean so that one edge of the knife is spaced farther from the axis of rotation of the block than the other. The knife is so set for each block and thereby cuts veneer along the taper whereby the length of the veneer cut at the end of the knife farther from the axis of rotation is longer than that cut at the end of the knife cut closer to the axis of rotation. The veneer so formed is clipped into suitable lengths for the purpose to which the veneer is to be applied as indicated by the station 4 before its curvature reaches an unacceptable level.

Figure 2:
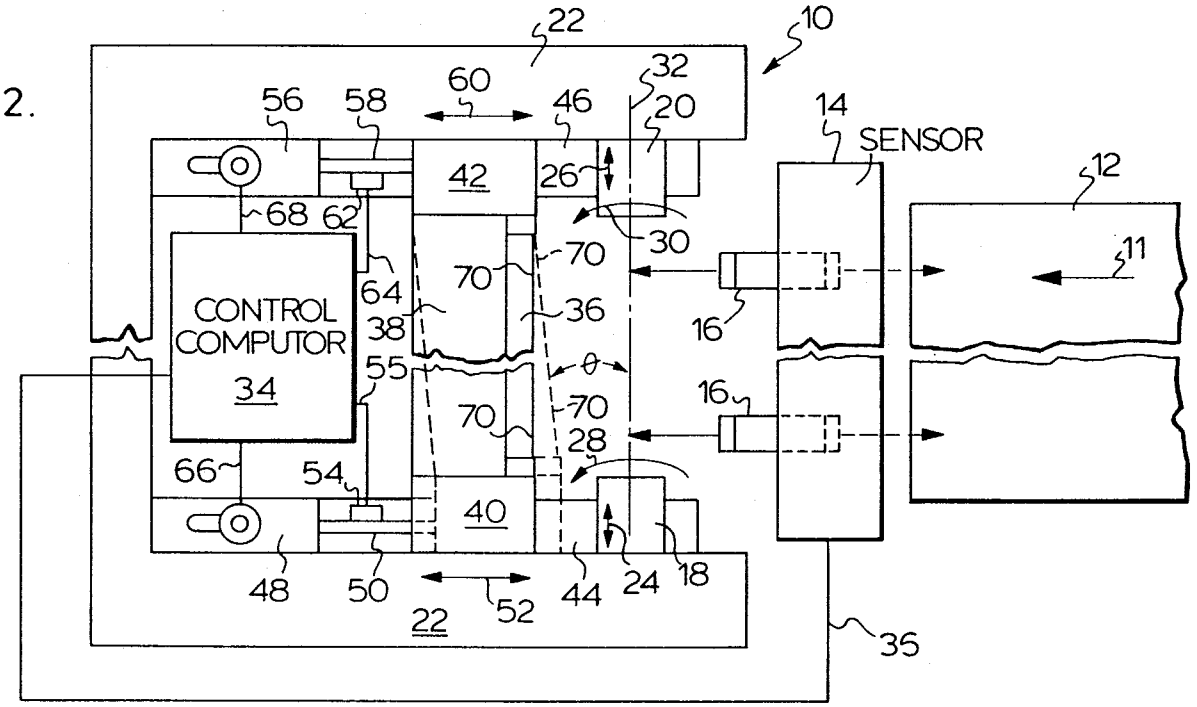
FIG. 2 is a schematic planned view of a lathe to which the present invention has been applied.

The present invention will become more clear by reference to FIG. 2. In this drawing the blocks of wood are fed into the peeling lathe 10 on conveyor 12 with their longitudinal axis generally perpendicular to the direction of movement as indicated by arrow 11. Each wooden block (not shown) is sensed by sensor schematically indicated at 14 which senses the shape of the block, activates a positioner 16 which may rotate the log to facilitate scanning of its shape by scanner 14 then clamps the log in a selected orientation for delivery to the lathe 10. The positioner 16 positions the bolt or tapered block or bolt clamped therein into the rotating mechanism of lathe 10 which may be composed of chucks schematically indicated at 18 and 20 mounted in the frame 22 of the lathe and which are axial as indicated by the arrows 24 and 26 and rotatable as indicated by the arrows 28 and 30 mounted. The chucks 18 and 20 mount the log or block and rotate it on an axis as determined by the sensor 14 and as positioned by the positioner 16 aligned with the rotational axis indicated by the dot dash line 32 of the chuck.

The information relating to the shape of the log and how it is mounted with its center rotation on the center line or axis 32 is fed to a control computer 34 via the line 35 to control the angular position and advancement of the knife 36 as will be described hereinbelow.

The knife as schematically illustrated at 36 is mounted in a knife carriage 38 the opposite ends of which are mounted in a side block 40 and 42 respectively which in turn are guided for movement on suitable guide slides or the like, schematically illustrated at 44 and 46 respectively.

Block 40 is driven by a suitable drive means such as the hydraulic cylinder means 48 the piston rod 50 of which is connected to the block 40 to move the block 40 backward and forward along the slide 44 as indicated by the arrow 52. The movement of the rod or shaft 50 is measured by a suitable measuring means 54 which communicates this information to the control computer 34 so that the position of the block 40 is known at all times. Similarly, the hydraulic cylinder 56 operates the shaft or piston 58 to move the block 42 back and forth along the track or slide 46 as indicated by the arrow 60. The position or movement of the shaft 58 is similarly monitored by a sensor 62 and this information fed to the control or main computer 34 via line 64 so that the position of the block 42 is also always known. The control computer 34 controls independently via lines 66 and 68 the hydraulic cylinders or the like 48 and 56 respectively.

When a tapered log or block is centered and rotated along the axis 32 the knife blocks 40 and 42 are independently advanced to bring the cutting edge into the proper cutting angle relative to the axis 32 in accordance with the information provided by the sensor 14. Assuming the larger end of the block mounted for rotation around the axis 32 is adjacent to chuck 20 then the block 40 is advanced toward the axis 32 into a position relative to the block 200 indicated by the dash lines so that the cutting edge 70 is now at an angle A to the axis 32. This angle A is determined by the shape of the log or block turning in the lathe. The angle A may correspond with the sensed cone angle of the block as it rotates on axis 32. In one embodiment of the present invention, both ends of the knife, i.e. the knife blocks 40 and 42 are then advanced simultaneously at essentially the same rate as is conventional practice to continue cutting at the angle A relative to the axis of rotation and produce a uniform thickness veneer product, but with one side edge longer than the other so the veneer tends to curl.

It should be noted that in conventional lathes the cutting edge 70 is normally positioned in a horizontal plane containing the axis of rotation 32 so that the angle A is measured in that horizontal plane. In conventional operation, the edge 70 would be held substantially parallel to the axis of rotation 32.

In conventional operation as shown in FIG. 5, the volume bounded by the outside surface of the bolt or block 72 as indicated by the lines 74 would be cut away as indicated by the cross-hatched areas 76 to produce a right cylindrical section having its sides as indicated by the lines 78 defining the inside portion of the anular section 76. The volume represented by the cross-hatched section 76 is generally wasted and the central right cylindrical section is peeled via the knife 30 along lines such as those indicated at 80 to reduce the size of the block to a cylindrical core generally indicated at 82 having the cylindrical volume between the two dotted lines 84, i.e. the volume between the lines 78 and 84 produces usable veneer whereas the volume 82 in the core and the volume formed by the hollow frustro conical section 76 are all wasted.

When practicing one embodiment of the present invention as illustrated in FIG. 4, the knife 30 is set at an angle A to the axis of rotation 32 by relatively moving one axial end relative to the other which as illustrated is preferably substantially the same angle as the conical shape of the outside wall 74 of the bolt 72. The knife is then advanced into the bolt or block 72 with the side blocks 40 and 42 advancing at substantially the same speed so that a substantially uniform thickness veneer is produced, i.e. the angle A is held constant. This operation is continued until the bolt is reduced to the frustro conical shape as indicated by the dash lines 86 which indicate the outer surface of a frustro conical core 88 that will be left when the peeling operation is completed. It will be noted that extra waste material in the core, i.e. the difference in material in a right cylindrical core as indicated at 82 in FIG. 3 and the frustro conical core indicated at 88 in FIG. 4 is the volume of the hollow frustro conical section between the walls 90 and the frustro conical outside walls 86 of the conical core 88, i.e. the volume indicated by the hatched areas 92.

It will be apparent that the hatched volume of the hollow cone 92 is significantly less than that of the hollow cone 76 and thus the amount of usable veneer obtained is significantly greater (by better than 5% and generally better than 7%) than the amount of veneer obtainable when cutting in the manner described in FIG. 3.

In both FIGS. 3 and 4, the veneer formed as indicated at 94 in FIG. 6 has the same thickness throughout its width, i.e. both side edges are of the same thickness.

The cutting pattern illustrated in FIG. 5 is significantly different from that of FIG. 4. In this arrangement, at least the veneer cut from a tapered bolt 72 is also tapered, i.e. it is thicker at the larger diameter end of the bolt than at the smaller diameter end of the bolt. This difference in thickness will be determined by the difference in diameter of the bolt at the larger diameter end relative to the smaller diameter end, i.e. the cone angle of the bolt being turned around axis 32.

When cutting such a tapered veneer in one manner of operation, the rate of advance of the two blocks 40 and 42 will be controlled so that in the illustrated arrangement (wherein the larger end of the bolt is adjacent to block 42) after the initial alignment of the edge 70 relative to the outer wall 74 of the bolt 72, the block 42 advances more quickly than does the block 40 so that the veneer produced is thicker at the larger end 96 of the bolt 72 than at the smaller end 98 thereby to produce a tapered veneer, i.e. a veneer cut thicker adjacent the end 96 than adjacent the end 98. Preferably, this difference in thickness is such that when the outer surface of the core 100 left when peeling is complete as indicated by the lines 102 is reached, the knife blade edge 70 will be substantially parallel to the axis of rotation 32 to thereby leave a substantially right cylindrical core 102 and minimize wastage.

In some cases it may be desirable to cut initially to produce veneer having the maximum tolerable thickness difference from one side to the other to form the bolt into a substantially right cylindrical shaped indicated by the dot sash line 104 in FIG. 5 as soon as possible or in any event well before peeling is completed and then to cut veneer of uniform thickness (not tapered) through the remainder of the peeling of the bolt, i.e. between the lines 102 and 104. This technique will result in a minium curling of the veneer. Alternatively the tapered cutting may also be controlled to maintain the difference in thickness at opposite sides of the veneer constant so that the veneer produced in the peeling of that bolt all has substantially the same tapered thickness profile regardless of its location in the bolt being peeled. Obviously the above alternatives are not absolute and one may operate somewhere in between if desired and in some cases finish leaving a tapered core.

It will be apparent that the initial angular position of the blade edge 70 as indicated by the angle A when practicing in accordance to the embodiment illustrated in FIG. 5 may be slightly different than that shown in FIG. 4 in that it will be slightly less so that the depth of cut at the large diameter end 96 will be deeper than at the small diameter end 98 of the block 72.

The tapered veneer cut when practicing according to FIG. 5 is as above indicated thicker at one end than the other so that the thickness of the narrow end would be t− while the thickness at the thicker end would be t+ and the thickness at the middle would be equal to t so that the average or nominal thickness of the veneer would be the same as the nominal thickness t of the veneer of FIG. 6.

It will be apparent that when practicing the invention as taught in FIGS. 4 and 5 the length of the veneer cut at the thick end or larger end 96 will be longer than the veneer cut at the smaller end 98 so that the veneer formed as indicated 104 will tend to curve as indicated by the lines 106 and 108 at opposite ends of the veneer corresponding to the ends 96 and 98 respectively of the block. This veneer may be clipped to suitable lengths depending on the end purpose to which it will be used. If it is to be used to make strand lumber, it will be clipped relatively closely as indicated by the line 110 to produce a plurality of strips or strands 112. If the veneer 104 or 94 made for example in accordance with FIG. 4 embodiment is to be used for other purposes where wider sections would be preferred the spacing between the cutoff sections may be significantly larger provided the arc is not sufificient to interfere with subsequent operations of the equipment, i.e. the veneer 104 or 94 could be severed along lines spaced as indicated at 114 from the lead end 116 of the veneer say every 2 feet.

Having described the invention, modifications will be evident to those skilled in the art without departing from the spirit of the invention as defined in the appended claims.

I claim:

1. A method of peeling veneer from a tapered wood block having a larger diameter end and a smaller diameter end comprising sensing the shape of said block, mounting said block to rotate about a rotational axis in a veneer lathe for peeling by a cutting edge to form a veneer, independently moving one axial end of said cutting edge relative to the other in accordance with said sensed shape to adjust said cutting edge to a cutting angle that it is not parallel to said axis of rotation at the commencement of said peeling to produce veneer with the axial end of said cutting edge adjacent the larger diameter end of said block spaced farther from said axis of rotation of said block then the opposite end of said cutting edge.

2. A method as defined in claim 1 wherein said cutting angle is substantially equal to the angle of taper of said wood block as sensed by said sensing mean.

3. A method as defined in claim 1 further comprising holding said cutting angle substantially constant by uniformly advancing both axial ends of said cutting edge until said peeling is completed so that a substantial uniform cross-section veneer is formed and a conical core remains after completion of said peeling.

4. A method as defined in claim 2 further comprising holding said cutting angle substantially constant by uniformly advancing both axial ends of said cutting edge until said peeling is completed so that a substantial uniform cross-section veneer is formed and a conical core remains after completion of said peeling.

5. A method as defined in claim 1 wherein said cutting angle is less than said taper sensed by said sensing means.

6. A method as defined in claim 5 further comprising continuously changing said cutting angle as said block is peeled so that a tapered veneer thicker at one side edge than the other is produced, said one side edge being formed from said block adjacent said larger diameter end of said block.

7. A method as defined in claim 6 further comprising continuing said continuous changing until said cutting edge is substantially parallel to said axis and completing said peeling with said cutting edge parallel to said axis before advancing each end of said cutting edge at the same rate.

8. A method as defined in claim 1 further comprising continuously changing said angle as said block is peeled so that a tapered veneer thicker at one side edge than the other is produced, said one side edge being formed from said block adjacent said larger diameter end of said block.

9. A method as defined in claim 8 further comprising continuing said continuous changing until said cutting edge is substantially parallel to said axis and completing said peeling with said cutting edge parallel to said axis by advancing each end of said cutting edge at the same rate.

* * * * *